US007090707B1

(12) United States Patent
Barot

(10) Patent No.: US 7,090,707 B1
(45) Date of Patent: Aug. 15, 2006

(54) COMBUSTION CHAMBER DESIGN FOR A QUENCH GASIFIER

(76) Inventor: Devendra T. Barot, 1814 Alcorn Bayou Dr., Sugar Land, TX (US) 77479

( * ) Notice: Subject to any disclaimer, the term of this patent is extended or adjusted under 35 U.S.C. 154(b) by 0 days.

(21) Appl. No.: 09/482,023

(22) Filed: Jan. 13, 2000

Related U.S. Application Data

(60) Provisional application No. 60/162,959, filed on Nov. 2, 1999.

(51) Int. Cl.
*C10J 3/00* (2006.01)

(52) U.S. Cl. ..... 48/113; 48/202; 48/206; 48/73

(58) Field of Classification Search ..... 48/61, 48/62 R, 71, 72, 73, 77, 75, 63, 69, 74, 87, 48/89, 98, 99, 100, 101, 111, 119, 126, 200, 48/201, 209, 210, 197 FM, 113, 202, 203, 48/206; 422/164, 184.1, 198, 199, 224, 232, 422/240, 241

See application file for complete search history.

(56) References Cited

U.S. PATENT DOCUMENTS 4,574,002 A * 3/1986 Barot ..... 48/77

5,666,891 A * 9/1997 Titus et al. ..... 110/250

FOREIGN PATENT DOCUMENTS

JP 61222939 A * 10/1986
JP 61235493 A * 10/1986

* cited by examiner

*Primary Examiner*—Glenn Caldarola
*Assistant Examiner*—Tom Duong
(74) *Attorney, Agent, or Firm*—Conley Rose, P.C.

(57) ABSTRACT

A new combustion chamber design for a quench gasifier. Electrical heating is used in the throat area of the combustion chamber to achieve temperatures up to 3500° F. to melt ash deposits and to increase carbon conversion (reduce soot production). Silicon carbide and/or silicon nitride refractory materials are used in the hot face of the throat to withstand high temperatures and high temperature shocks. The proposed design reduces the capital cost of a gasification plant by eliminating the need for soot recovery and recycle system. This design also reduces the operating cost of the gasification plant by decreasing the frequent refractory damages that have been experienced in the throat area of the existing quench gasifiers.

14 Claims, 5 Drawing Sheets

COMBUSTION CHAMBER DESIGN FOR A QUENCH GASIFIER

CROSS-REFERENCE TO RELATED PATENT APPLICATIONS

The present application claims the benefit of U.S. Provisional Application Ser. No. 60/162,959, filed Nov. 2, 1999, entitled Combustion Chamber Design for a Quench Gasifier, which is hereby incorporated herein by reference.

STATEMENT REGARDING FEDERALLY SPONSORED RESEARCH OR DEVELOPMENT

Not applicable.

REFERENCE TO A MICROFICHE APPENDIX

Not applicable.

BACKGROUND OF THE INVENTION

Quench gasifiers are used to gasify ash containing hydrocarbon feedstocks such as residual oils, waste lubrication oils, petroleum cokes and coal. A typical quench gasifier design is shown in FIG. 1 (Reference: U.S. Pat. No. 4,828,579). The feedstock, the oxidant and a temperature moderator (either steam or carbon dioxide) are injected into the top portion of the gasifier through a burner and are mixed with one another in the reaction zone below the burner. Steam and carbon dioxide ($CO_2$) moderate the temperatures in the reaction zone and also act as reactants. The partial oxidation reactions that take place in this portion of the gasifier, called the combustion chamber, maintain the combustion chamber temperatures in the 2000 to 3000° F. range. The combustion chamber is lined with refractory materials such as alumina. Approximately 90.0 to 99.5 percent of the carbon in the feedstock is converted to the synthesis gases (syngas).

The bottom portion of the quench gasifier, called the quench chamber, is separated from the combustion chamber by the floor of the combustion chamber as shown in FIG. 1. The combustion chamber has an internal longitudinal length $L_1$, an external longitudinal length $L_2$, and an internal diameter $D_1$. A portion of the floor of the combustion chamber forms a constricted gasifier throat having an internal diameter $D_2$. The quench chamber is partially filled with water and is not lined with refractory. The quench chamber consists of three main components: the quench ring, the dip tube and the draft tube as shown in FIG. 1. The main functions of the quench chamber are to cool down the synthesis gases generated in the combustion chamber by mixing them with water and to saturate the gases with water vapor.

The constricted gasifier throat area which directs the gases from the combustion chamber to the quench chamber is normally the coolest portion of the combustion chamber because of its distance from the gasifier burner and the burner flame. This area tends to be cooler than the rest of the combustion chamber also due to its proximity to the quench ring through which cooling water is injected into the quench chamber. As a result, the ash in the feedstock, which is in its molten or semi-molten form in the center portion of the combustion chamber, tends to solidify and form deposits or plugs in the throat area of the gasifier. These deposits are more likely to form with feedstocks that contain metal compounds such as vanadium trioxide ($V_2O_3$) because these compounds solidify at temperatures lower than 3000° F. In addition to causing shutdown of the gasifier, these compounds also react and damage the alumina type refractories that have been used in existing gasifiers (see U.S. Pat. No. 5,464,592).

A new gasifier throat design is proposed in this invention to avoid ash deposits and plugging in the throat area of the gasifier and to avoid damage to the refractories in the throat area. The proposed design will use electrical resistor heating to achieve temperatures in the range of 3000 to 3500° F. The new design will also use refractory materials like silicon carbide and silicon nitride that can withstand higher temperatures and larger temperature shocks than alumina. With this new design, it will be possible to increase the gasifier carbon conversion, reduce the steam (moderator) consumption and reduce the frequent damages that have been experienced to the refractories in the throat area of existing gasifiers. The proposed design will also decrease the capital cost of oil gasification plants by eliminating the need for soot recycle system downstream and will reduce the plant operating cost by improving the reliability of the gasifier operations.

BRIEF SUMMARY OF THE INVENTION

Electrical heating and new refractory materials are proposed for the gasifier throat area, which will increase the throat area operating temperatures without increasing oxygen consumption. The high temperatures will improve the gasification process by increasing carbon conversion, reducing steam or $CO_2$ consumption and by eliminating ash deposits and plugging. The preferred shape for the gasifier throat with electrical heating is the wind tunnel shape proposed in the previous U.S. Pat. No. 4,574,002. The gasifier throat area is heated electrically using graphite resistors to maintain temperatures in the throat area between 3000 and 3500° F. At these temperatures, higher carbon conversion is achieved and ash deposits are melted and pushed out of the throat area by high syngas velocities achieved in the constricted throat area. The throat area refractories consist of three layers. The innermost layer or hot face that is exposed to the hot gases consists of silicon carbide or silicon nitride or a combination of the two materials. The middle layer consists of graphite resistors and the outermost layer consists of insulating refractories.

DETAILED DESCRIPTION OF THE INVENTION

Figure 1:
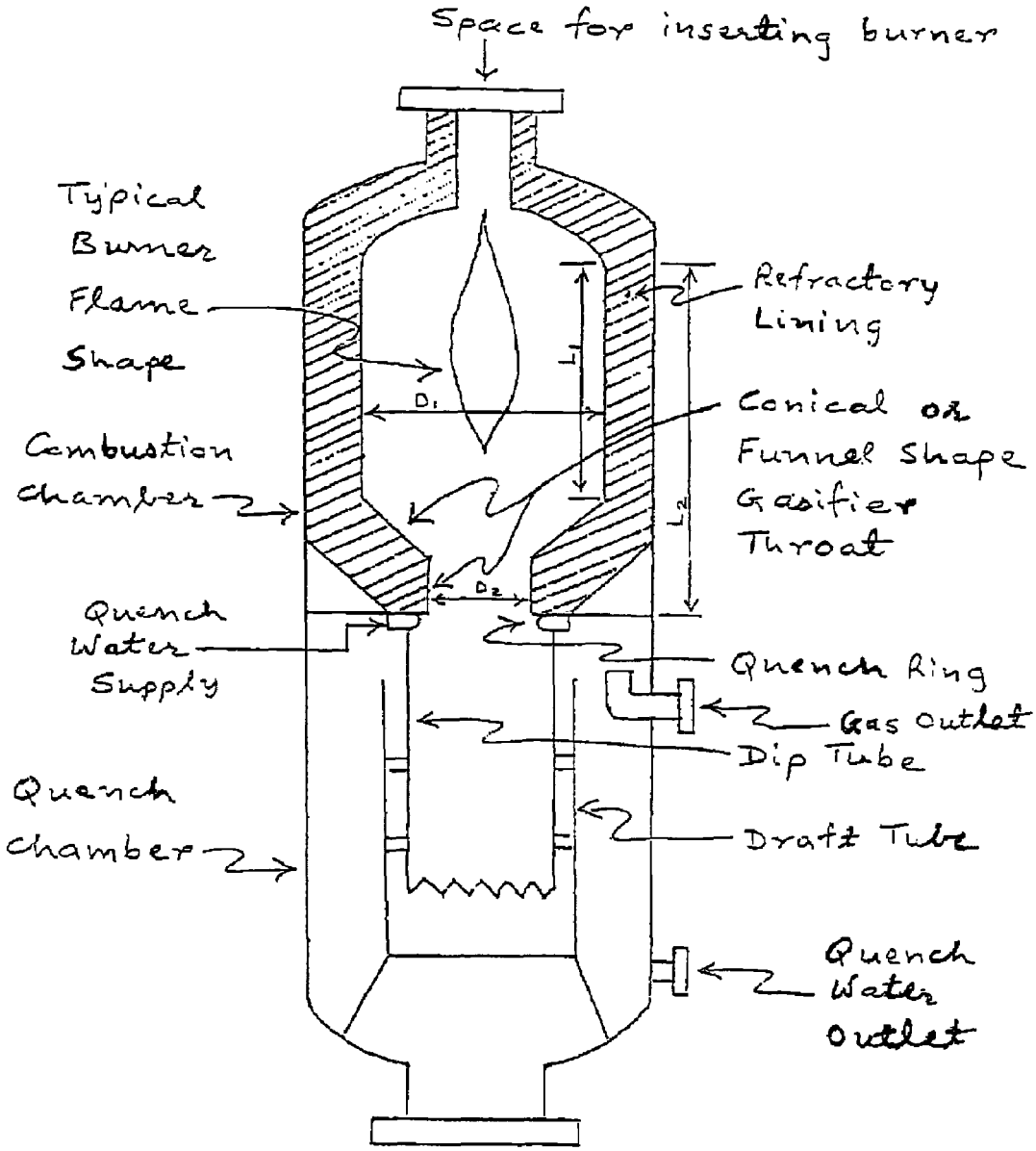
Figure 1 (Prior Art)
FIG. 1: Prior Art Example 1, Typical Quench Gasifier Design with Conical or Funnel Shape Throat.
Figure 2:
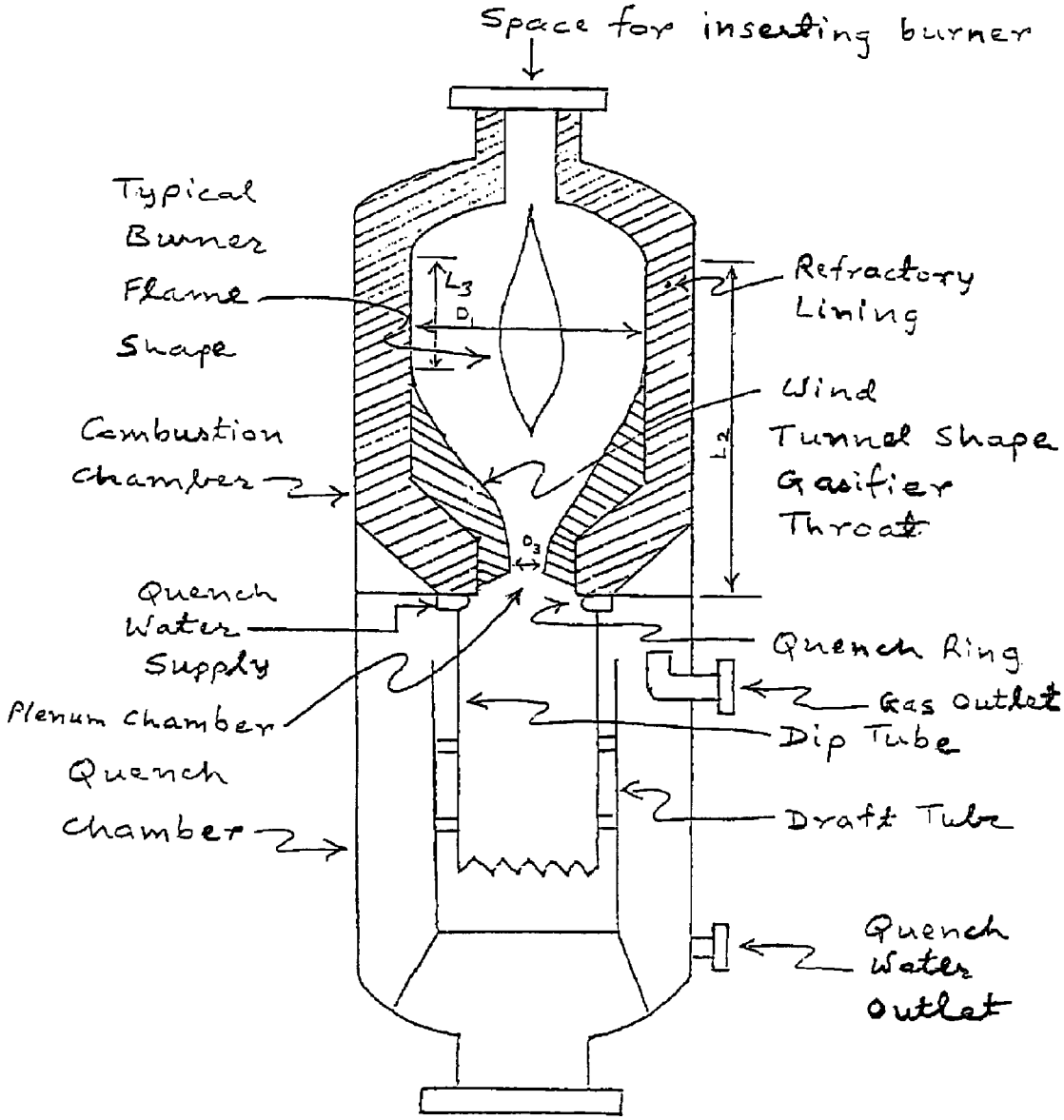
Figure 2 (Prior Art)
FIG. 2: Prior Art Example 2, Typical Quench Gasifier Design with Wind Tunnel Shape Throat.

A previous patent (U.S. Pat. No. 4,574,002) suggests changing the shape of the gasifier throat to avoid ash deposits and plugs in this area. The wind tunnel shape proposed in U.S. Pat. No. 4,574,002 is shown in FIG. 2. The combustion chamber again has an external longitudinal length $L_2$ and an internal diameter $D_1$. However, the modified gasifier throat causes the internal longitudinal length $L_3$ to decrease compared to the length $L_1$ of FIG. 1. Additionally, the modified gasifier throat has an internal diameter $D_3$. This shape provides a better chance of avoiding deposits and plugs in the throat area than the shape shown in FIG. 1. However, the wind tunnel shape is also susceptible to deposits and plugs particularly when feedstock contains metals or metal compounds that solidify at temperatures lower than 3000° F. due to the distance of the throat from the burner and its proximity to the quench ring component of the gasifier.

In order to avoid ash deposits and plugs in the throat area, particularly with feedstocks that contain vanadium trioxide type metal compounds, it is necessary to maintain temperatures in the throat area in the 3000 to 3500° F. At these higher temperatures, vanadium oxide type compounds (vanadium trioxide and all other metal compounds that melt and flow easily at temperatures in the 3000 to 3500° F. range) will melt and easily flow out of the throat and into the quench chamber. The throat refractory will have to withstand these high temperatures. Alumina type refractories that have been used in the throat area in the past are frequently damaged by vanadium oxide type compounds (see U.S. Pat. No. 5,464,592).

Figure 4:
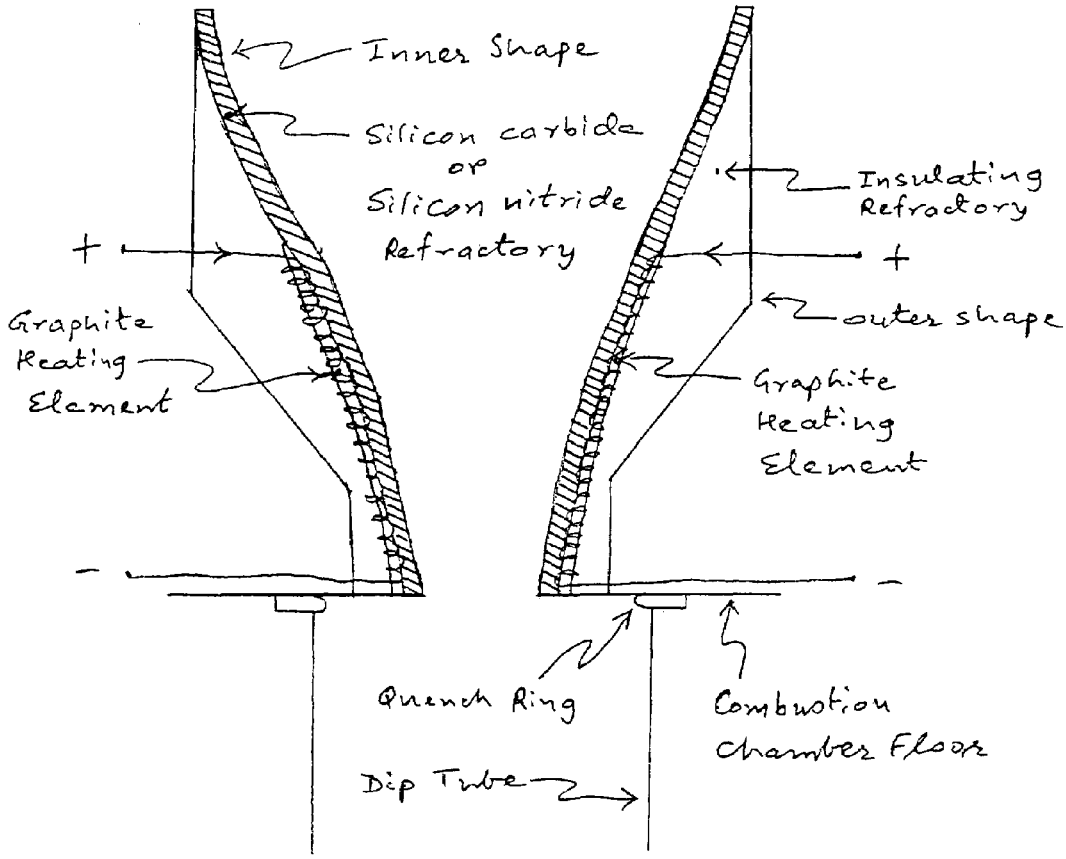
FIG. 4: Details of the New Throat Design.

This patent application proposes electrical heating (either with resistors or with electromagnetic waves) of the throat area to avoid low temperatures in the throat area. This patent application also proposes that the hot face of the throat area refractory be silicon carbide, silicon nitride or a combination of the two. As shown in FIG. 4, the electrical heating elements will be made of graphite and graphite heating elements will be used behind the hot face material. The outermost layer of the throat block will be made of insulating refractory. This insulating refractory will prevent high temperature exposure of the combustion chamber floor and the quench ring.

Figure 3:
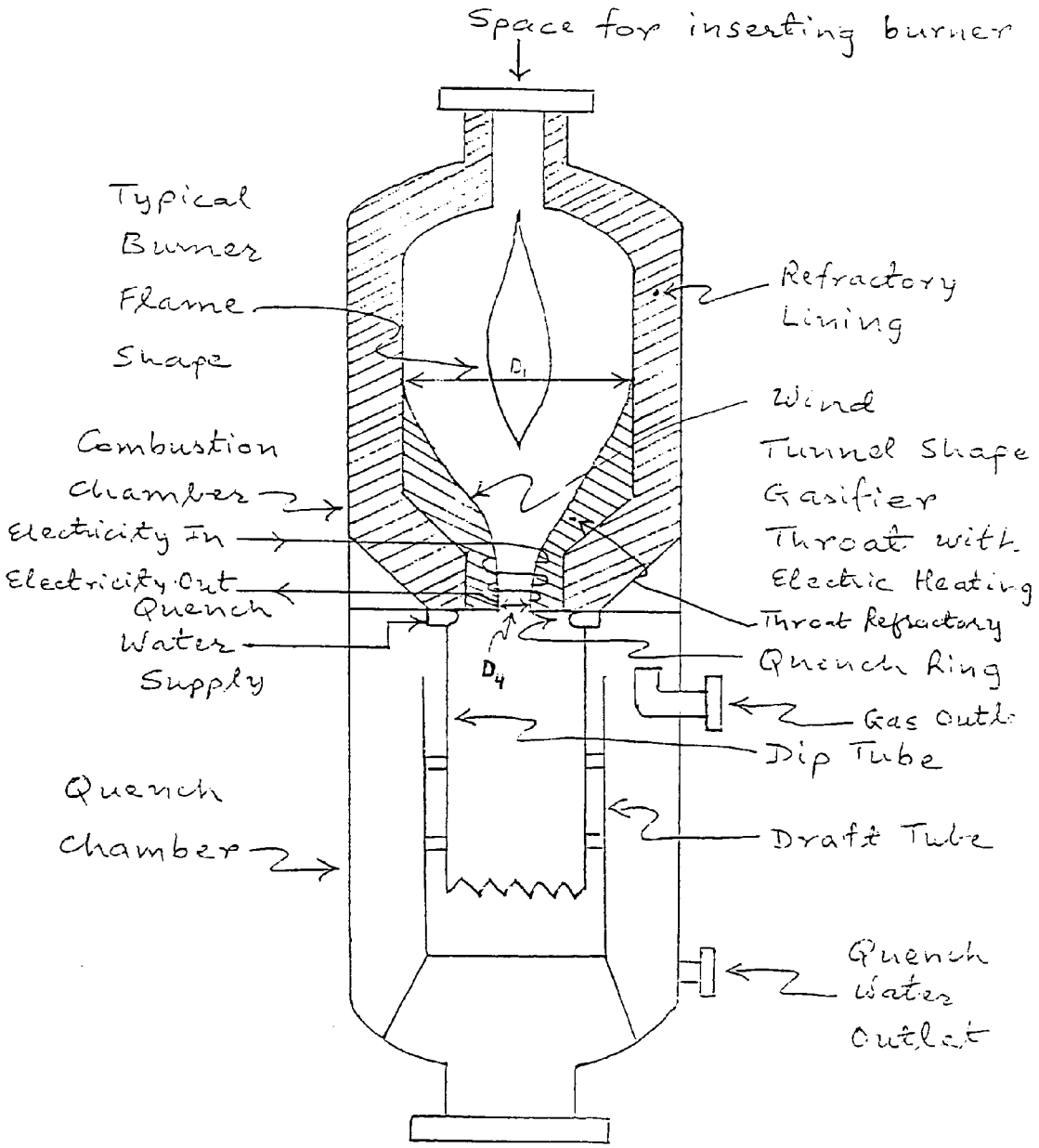
FIG. 3: New Art Example, New Quench Gasifier Design with Electric Heating of the Throat Area.

This new design will make it possible to control temperatures in any desired range in the throat area up to an upper temperature limit of about 3500° F. The design proposed in FIG. 3 shows an approximate wind tunnel shape, and a combustion chamber having an internal diameter $D_1$ and a modified gasifier throat having an internal diameter $D_4$. The throat does not have to be exactly in the wind tunnel shape. The essential features of this design are that the ratio $D_1/D_4$ be in the range of 3 to 6 and that the diameter of the throat shape should decrease as you move away from $D_1$ portion of the throat.

Figure 5:
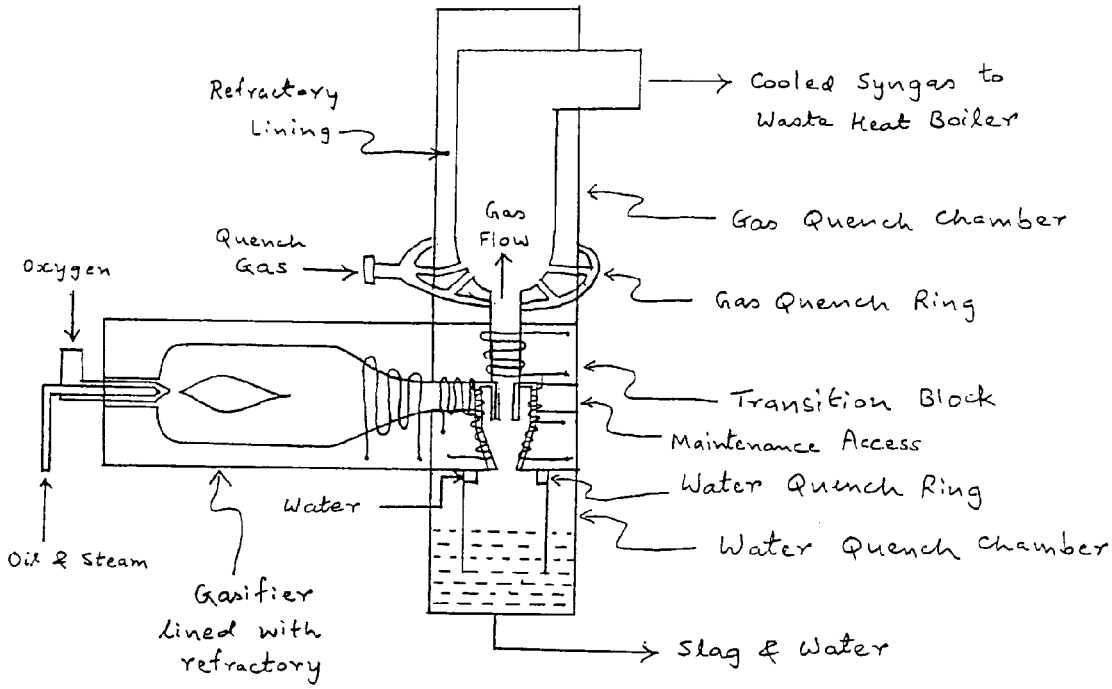
FIG. 5: New Combination Quench Gasifier.

FIG. 3 only shows an application for the electrical heating concept in the throat area of a vertical quench gasifier. In fact, this concept can also be applied to a horizontal reactor as shown in FIG. 5 or to the entire hot face of the combustion chamber. This concept can also be applied to any extension of the gasifier exit area such as the transition block area of FIG. 5.

FIG. 5 shows a combination quench gasifier. A portion of the syngas generated in the combustion chamber is quenched in water and the remaining syngas is quenched (cooled down) by injecting a cold quench gas.

The new combustion chamber throat design, shown in FIG. 3 and FIG. 4, will be more successful in preventing plugging in the throat area. This design will also eliminate the frequent damages that have occurred to the throat refractory, because silicon carbide and silicon nitride can withstand higher temperatures and the erosive and corrosive effects of vanadium oxide type compounds better than alumina.

This patent suggestion also proposes eliminating the plenum chamber area shown in FIG. 2. The quench ring area of the traditional quench gasifier is prone to frequent damage (References: U.S. Pat. No. 4,828,580 and U.S. Pat. No. 4,828,579). This new design (shown in FIG. 3) will be more successful in preventing damage to the quench ring than the designs shown in FIGS. 1 and 2, because the distance between the throat opening and the quench ring is longer in the new design. Overall, this new design will improve the gasifier on-stream time (reliability of operations) and thereby lower the gasifier operating cost.

The high temperatures obtained by electrical heating in the throat will also increase the gasification reaction rates and thereby increase the carbon conversion of the gasifier by 0.1 to 3.0 percent. This in turn will increase the syngas production of the gasifier without increasing either oxygen consumption or feedstock consumption.

The use of electrical heating and silicon carbide type refractories in the throat area will also reduce the consumption of the steam as a temperature moderator, because it will not be necessary to moderate the temperatures. Normally approximately 0.25 to 0.35 pound of steam is required for gasification of every 1.0 pound of residual oil or coke or coal. With this new design, the steam requirement will drop to 0.15 to 0.25 pound of steam per pound of feedstock.

Due to the increased carbon conversion achieved with this design, it will be possible to eliminate the soot recovery and soot recycle system that is normally employed downstream of the gasifier. Thus electrical heating of the throat area will reduce the gasification plant capital cost. The concept of electrical heating of the refractory can be extended to the entire gasifier hot face. If the entire hot face of the gasifier (not just the throat area) is electrically heated, it will be possible to preheat and cure the gasifier refractories electrically. There will be no need for using a preheat burner, a flue gas cooler and an aspirator (steam ejector) for preheating refractories. This will reduce the gasification plant capital cost further.

The invention claimed is:

1. A quench gasifier for gasifying ash-containing hydrocarbon feedstocks, comprising:

a combustion chamber for partially oxidizing carbon in the feedstocks to produce synthesis gases; and a quench chamber adjacent to said combustion chamber, said combustion chamber including a throat adjacent to said quench chamber for directing said gases from said combustion chamber to said quench chamber, characterized in that said throat includes:

an inlet adjacent to said combustion chamber, said inlet having an inlet diameter;

an outlet adjacent to said quench chamber, said outlet having an outlet diameter;

an inner surface and outer surface between said inlet and said outlet;

an electrical heating element between said inner and outer surfaces; and wherein said inlet diameter is greater than said outlet diameter.

2. The quench gasifier according to claim 1 wherein said inner surface comprises a wind tunnel profile.

3. The quench gasifier according to claim 1 wherein the ratio of said inlet diameter to said outlet diameter is at least 3.

4. The quench gasifier according to claim 3 wherein said ratio is in the range from 3 to 6.

5. The quench gasifier according to claim 1 wherein said quench chamber comprises a quench ring substantially axially adjacent to said throat outlet, such that the quench gasifier does not include a plenum chamber.

6. The quench gasifier according to claim 5 wherein said quench ring has an inner diameter that is greater than the diameter of said throat outlet.

7. The quench gasifier according to claim 1 wherein said heating element extends from said outlet to said inlet.

8. The quench gasifier according to claim 7 wherein said heating element is a spirally wound member having a first diameter near said throat inlet and a second diameter near said throat outlet, and wherein said first diameter is greater than said second diameter.

9. A quench gasifier for gasifying hydrocarbon feedstocks, comprising:

a combustion chamber for partially oxidizing the carbon in the feedstocks to produce synthesis gases and slag, a quench chamber adjacent to said combustion chamber, said quench chamber having a gas outlet for directing said gases away from said quench chamber; and wherein said combustion chamber includes a throat for directing said gases and said slag from said combustion chamber to said quench chamber, said throat comprising:

an inlet;

an outlet;

an outer surface between said inlet and said outlet;

an inner surface between said inlet and said outlet;

a heating element between said inner and outer surfaces; and wherein said inner surface has a curved, conical contour.

10. The quench gasifier according to claim 9 wherein said heating element is near said inner surface such that said heating element substantially follows said curved, conical contour of said inner surface.

11. A quench gasifier for gasifying ash-containing hydrocarbon feedstocks, comprising:

a combustion chamber for partially oxidizing carbon in the feedstocks to produce synthesis gases; and a quench chamber adjacent to said combustion chamber, said combustion chamber including a throat adjacent to said quench chamber for directing said gases from said combustion chamber to said quench chamber, characterized in that said throat includes:

an inlet adjacent to said combustion chamber, said inlet having an inlet diameter;

an outlet adjacent to said quench chamber, said outlet having an outlet diameter;

an inner surface and outer surface between said inlet and said outlet; and an electrical heating element between said inner and outer surfaces wherein said heating element is configured to maintain said inner surface at a temperature of at least 3000° F.

12. The quench gasifier according to claim 11 wherein the feedstocks include metal compounds such as vanadium trioxide, and wherein the feedstocks are substantially free of solidified metal compounds.

13. The quench gasifier according, to claim 11 wherein said heated inner surface causes the partially oxidized carbon in the feedstocks to increase in the range of 0.1 to 3.0 percent.

14. The quench gasifier according to claim 11 wherein said heated inner surface causes a steam consumption rate in the range of 0.15 to 0.25 pounds of steam per pound of feedstocks.

* * * * *

UNITED STATES PATENT AND TRADEMARK OFFICE

CERTIFICATE OF CORRECTION

PATENT NO. : 7,090,707 B1
APPLICATION NO. : 09/482023
DATED : August 15, 2006
INVENTOR(S) : Devendra T. Barot It is certified that error appears in the above-identified patent and that said Letters Patent is hereby corrected as shown below:

Claim 12, line 22, "the feedstocks" should be changed to --the produced synthesis gases in said throat--.

Claim 13, line 24, delete the comma.

Claim 13, lines 25-26, "the partially oxidized carbon in the feedstocks" should be changed to --the conversion of carbon to synthesis gases--.

Signed and Sealed this

Twenty-eighth Day of August, 2007

JON W. DUDAS
*Director of the United States Patent and Trademark Office*

UNITED STATES PATENT AND TRADEMARK OFFICE

CERTIFICATE OF CORRECTION

PATENT NO. : 7,090,707 B1
APPLICATION NO. : 09/482023
DATED : August 15, 2006
INVENTOR(S) : Devendra T. Barot It is certified that error appears in the above-identified patent and that said Letters Patent is hereby corrected as shown below:

Claim 12, line 22, "the feedstocks" should be changed to --the produced synthesis gases in said throat--.

Claim 13, line 24, delete the comma.

Claim 13, lines 25-26, "the partially oxidized carbon in the feedstocks" should be changed to --the conversion of carbon to synthesis gases--.

Signed and Sealed this

Eighteenth Day of September, 2007

JON W. DUDAS
*Director of the United States Patent and Trademark Office*